US008138439B2

(12) United States Patent
Malingowski et al.

(10) Patent No.: US 8,138,439 B2
(45) Date of Patent: Mar. 20, 2012

(54) LIMITER INCLUDING A NUMBER OF GAS CHANNELS AND ELECTRICAL SWITCHING APPARATUS EMPLOYING THE SAME

(75) Inventors: Richard P. Malingowski, Finleyville, PA (US); David E. Little, Midland, PA (US); Kelly J. McCarthy, Pittsburgh, PA (US); Matthew R. Hussey, Trafford, PA (US)

(73) Assignee: Eaton Corporation, Cleveland, OH (US)

( * ) Notice: Subject to any disclaimer, the term of this patent is extended or adjusted under 35 U.S.C. 154(b) by 197 days.

(21) Appl. No.: 12/704,191

(22) Filed: Feb. 11, 2010

(65) Prior Publication Data

US 2011/0192822 A1 Aug. 11, 2011

(51) Int. Cl.
*H01H 33/18* (2006.01)

(52) U.S. Cl. ..... 218/35; 218/157; 335/201

(58) Field of Classification Search ..... 218/22, 218/155–157, 35; 335/201–202
See application file for complete search history.

(56) References Cited

U.S. PATENT DOCUMENTS 3,745,369 A 7/1973 Yamagata
3,956,723 A * 5/1976 Dickens et al. ..... 335/201
4,485,283 A * 11/1984 Hurtle ..... 218/22
4,965,544 A * 10/1990 Kelaita et al. ..... 335/202
5,153,545 A * 10/1992 Ferullo et al. ..... 335/201
5,304,761 A * 4/1994 Rosen et al. ..... 218/157
6,144,540 A * 11/2000 Arnold et al. ..... 361/93.9
6,222,147 B1 * 4/2001 Doughty et al. ..... 218/157
7,362,207 B2 4/2008 Malingowski et al.
7,558,040 B2 7/2009 Malingowski et al.

OTHER PUBLICATIONS

ABB SACE S.P.A., "SACE Isomax S. The largest project in moulded-case circuit-breakers" 28 pp.

* cited by examiner

*Primary Examiner* — Truc Nguyen
(74) *Attorney, Agent, or Firm* — John A. Kastelic; Martin J. Moran

(57) ABSTRACT

A limiter includes a housing having a number of gas ports, a number of gas vents and a number of gas channels. Each of the number of gas channels is between a corresponding one of the number of gas ports and a corresponding one of the number of gas vents. The limiter also includes a number of first terminals, a number of second terminals, and a number of limiter devices. Each of the number of limiter devices is electrically connected between a corresponding one of the number of first terminals and a corresponding one of the number of second terminals. Each of the number of gas ports is structured to receive a corresponding ionized gas flow for passage through a corresponding one of the number of gas channels to the corresponding one of the number of gas vents.

23 Claims, 5 Drawing Sheets

LIMITER INCLUDING A NUMBER OF GAS CHANNELS AND ELECTRICAL SWITCHING APPARATUS EMPLOYING THE SAME

BACKGROUND

1. Field

The disclosed concept pertains generally to electrical switching apparatus and, more particularly, to circuit interrupters including a limiter. The disclosed concept also pertains to limiters.

2. Background Information

Current limiters employ a current interruption device that rapidly and effectively brings the current to a relatively low or zero value upon the occurrence of a fault or another overload condition.

Circuit protection devices protect electrical equipment from damage when excessive current flows in a power circuit. Such devices have a relatively low resistivity and, accordingly, a relatively high conductivity under normal current conditions of the power circuit, but are "tripped" or converted to a relatively high or complete resistivity when excessive current and/or temperature occurs. When the device is tripped, a reduced or zero current is allowed to pass in the power circuit, thereby protecting power circuit conductors and corresponding load(s) from electrical and thermal damage.

Conventional circuit interrupters, circuit protection or current limiting devices include, but are not limited to, circuit breakers, fuses (e.g., expulsion fuses), thermistors (e.g., PTC (Positive Temperature Coefficient) conductive polymer thermistors), and the like. These devices are current rated for the maximum current the device can carry without interruption under a load.

For example, circuit breakers typically contain a load sensing element (e.g., a bimetal; a hot-wire; a magnetic element) and separable contacts, which open under overload or short circuit conditions. Most circuit breakers have to be manually reset either locally at the circuit breaker or through a remote switch.

Fuses typically contain a load sensing fusible element (e.g., metal wire), which when exposed to current (I) of fault magnitude rapidly melts and vaporizes through resistive (R) heating ($I^2R$). Formation of an arc in the fuse, in series with the load, can introduce arc resistance into the power circuit to reduce the peak let-through current to a value significantly lower than the fault current. Expulsion fuses may further contain gas-evolving or arc-quenching materials which rapidly quench the arc upon fusing to eliminate current conduction. Fuses generally are not reusable and must be replaced after overload or short circuit conditions because they are damaged inherently when the power circuit opens.

Low voltage circuit breakers are often connected in series with current limiters, in order to significantly increase the short circuit switching capacity in low voltage electrical networks and to significantly limit cut-off currents. See, for example, U.S. Pat. Nos. 7,558,040; and 7,362,207. Such limiters are designed to transition rapidly, in case of a short circuit, from a low-resistance state to a high-resistance state and, thus, provide rapid current limiting and disconnection. Some limiters employ, for example, fuses, such as fusible wire elements to accomplish this function.

Many known limiters are fused devices (non-reusable) that do not have out-gassing concerns.

If a limiter could be coupled to, for example, the line end of a circuit breaker, then it would essentially block an ionized gas stream that comes from the circuit breaker during a fault interruption.

A number of circuit breaker manufacturers vent ionized gas from the line end of their circuit breakers. Other manufacturers of circuit breakers employ a double-break contact system with multiple arc chutes that can have ionized gas venting out both ends of the circuit breaker during a fault interruption.

There is room for improvement in limiters for electrical switching apparatus.

SUMMARY

These needs and others are met by embodiments of the disclosed concept, which provide a limiter that can be coupled to a circuit interrupter.

In accordance with one aspect of the disclosed concept, an electrical switching apparatus comprises: a circuit interrupter comprising: a first housing including a number of first gas vents structured to provide a number of ionized gas flows, a number of first terminals, a number of second terminals, a number of separable contacts, each of the number of separable contacts being electrically connected between a corresponding one of the number of first terminals and a corresponding one of the number of second terminals, and an operating mechanism structured to open and close the number of separable contacts; and a limiter comprising: a second housing including a number of gas ports, a number of second gas vents and a number of gas channels, each of the number of gas channels being between a corresponding one of the number of gas ports and a corresponding one of the number of second gas vents, a number of third terminals, a number of fourth terminals, and a number of limiter devices, each of the number of limiter devices being electrically connected between a corresponding one of the number of third terminals and a corresponding one of the number of fourth terminals, wherein the limiter is coupled to the circuit interrupter, wherein each of the number of third terminals is electrically connected to the corresponding one of the number of second terminals, and wherein each of the number of gas ports is structured to receive a corresponding one of the number of ionized gas flows from a corresponding one of the number of first gas vents for passage through a corresponding one of the number of gas channels to the corresponding one of the number of second gas vents.

As another aspect of the disclosed concept, a limiter comprises: a housing comprising a number of gas ports, a number of gas vents and a number of gas channels, each of the number of gas channels being between a corresponding one of the number of gas ports and a corresponding one of the number of gas vents; a number of first terminals; a number of second terminals; and a number of limiter devices, each of the number of limiter devices being electrically connected between a corresponding one of the number of first terminals and a corresponding one of the number of second terminals; wherein each of the number of gas ports is structured to receive a corresponding ionized gas flow for passage through a corresponding one of the number of gas channels to the corresponding one of the number of gas vents.

The number of limiter devices may comprise: a number of arc interruption structures structured to provide a number of ionized gas flows to the number of gas vents, a number of separable contacts disposed proximate the number of arc interruption structures, each of the number of separable contacts being electrically connected between the corresponding one of the number of first terminals and the corresponding one of the number of second terminals, and a mechanism structured to open and close the number of separable contacts of the number of limiter devices.

Each of the number of limiter devices may comprise: an arc chamber; a stationary conductor; a movable conductor; and a slot motor structured to cause the movable conductor to separate from the stationary conductor in response to an overcurrent condition.

Each of the number of gas channels may include a first gas channel portion communicating with a second gas channel portion. The first gas channel portion may communicate with the corresponding one of the number of gas ports; the second gas channel portion may communicate with the corresponding one of the number of gas vents; the first gas channel portion may be structured to isolate the corresponding ionized gas flow from a corresponding one of the number of arc interruption structures; each of the number of arc interruption structures may further be structured to provide the corresponding one of the number of ionized gas flows to the second gas channel portion of the corresponding one of the number of gas channels; and the second gas channel portion may be structured to combine the corresponding ionized gas flow from the first gas channel portion of the corresponding one of the number of gas channels with the corresponding one of the number of ionized gas flows prior to the corresponding one of the number of gas vents.

BRIEF DESCRIPTION OF THE DRAWINGS

A full understanding of the disclosed concept can be gained from the following description of the preferred embodiments when read in conjunction with the accompanying drawings in which.

DESCRIPTION OF THE PREFERRED EMBODIMENTS

Figure 1:
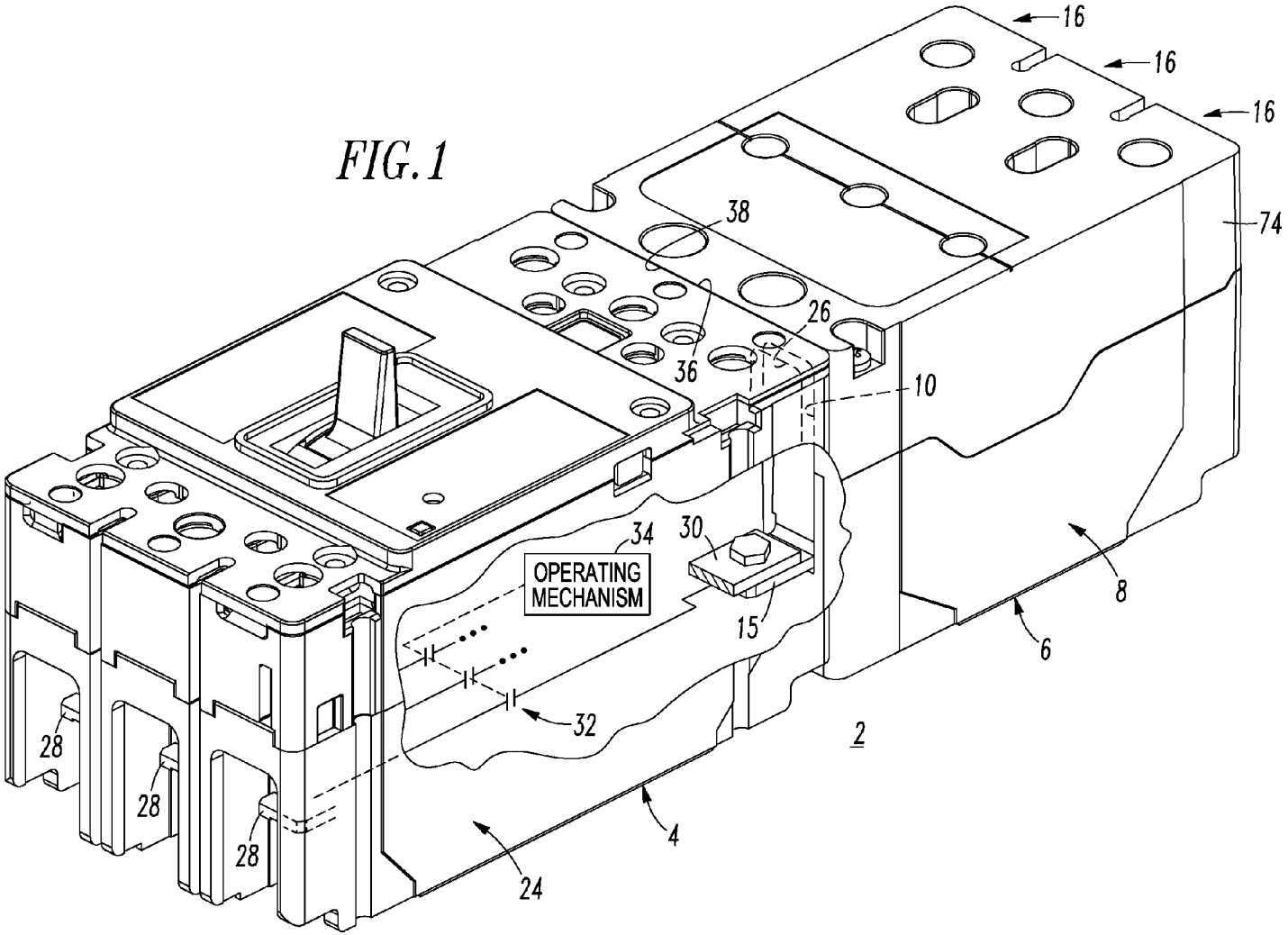
FIG. 1 is an isometric view of a circuit breaker and limiter system in accordance with embodiments of the disclosed concept.
Figure 2:
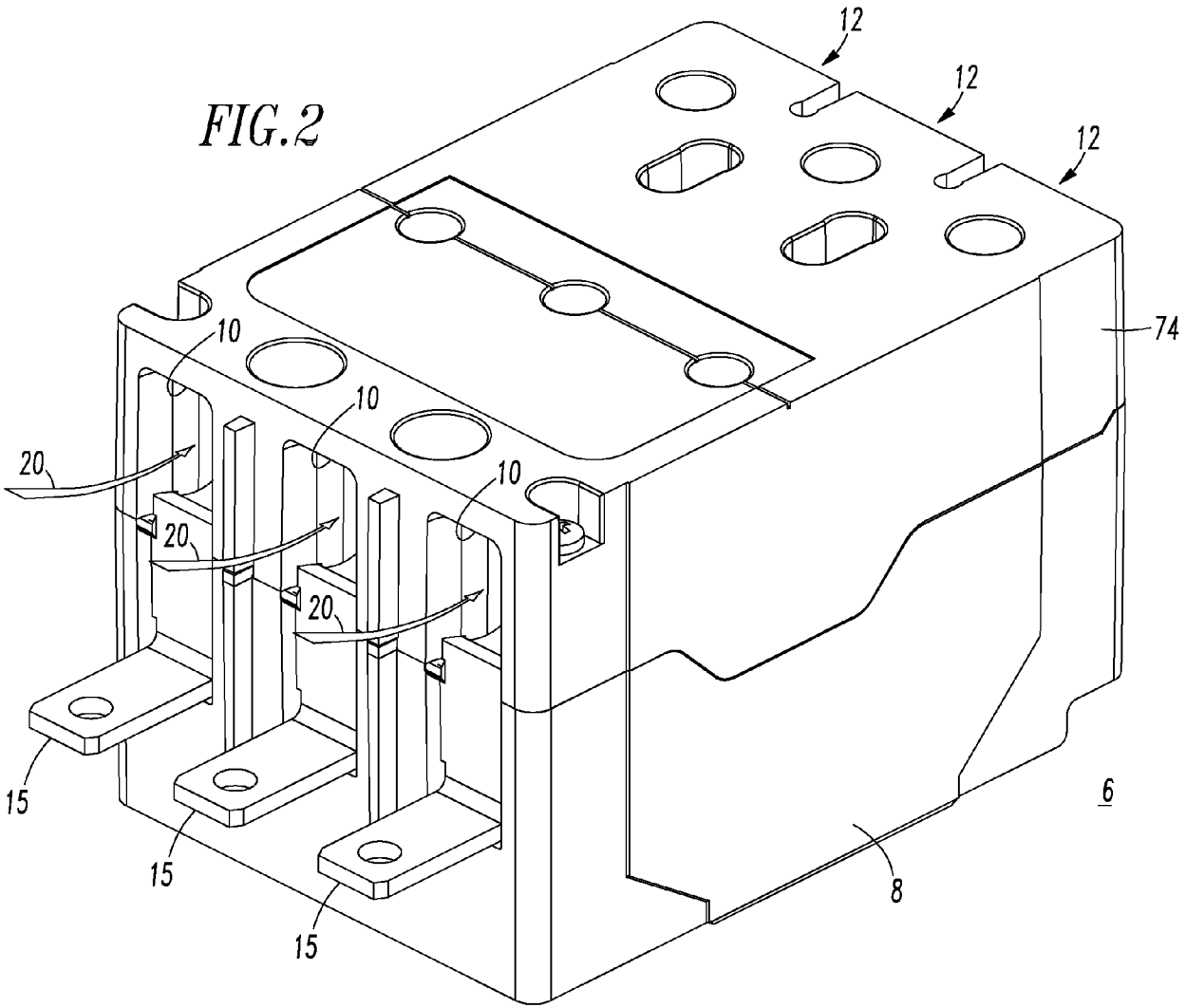
FIG. 2 is an isometric view of the limiter of FIG. 1.

As employed herein, the term "number" shall mean one or an integer greater than one (i.e., a plurality).

As employed herein, the statement that two or more parts are "coupled" together shall mean that the parts are joined together either directly or joined through one or more intermediate parts.

As employed herein, the terms "fastener" and "fastening mechanism" refer to any suitable connecting or tightening mechanism expressly including, but not limited to, screws, bolts, nuts (e.g., without limitation, lock nuts) and combinations thereof.

Directional phrases used herein, such as, for example, top, bottom, front, back, left, right, upper, lower and derivatives thereof, relate to the orientation of the elements shown in the drawings and are not limiting upon the claims unless expressly recited therein.

The disclosed concept is described in association with a three-phase circuit breaker, although the disclosed concept is applicable to electrical switching apparatus, such as circuit interrupters, having any number of poles or phases.

The disclosed limiter can be mounted on either end of a circuit breaker. A limiter mounted on the load end of a circuit breaker has gas venting for both ends of the combination. The disclosed circuit breaker has venting from the line end, although the disclosed concept is applicable to line or load end mounting. Load end mounting of the example circuit breaker 4 and the example limiter 6 will not have the example circuit breaker ionized gas flow 20 going through the example limiter 6. However, it will be appreciated that a different circuit breaker/limiter structure can be provided.

Figure 3:
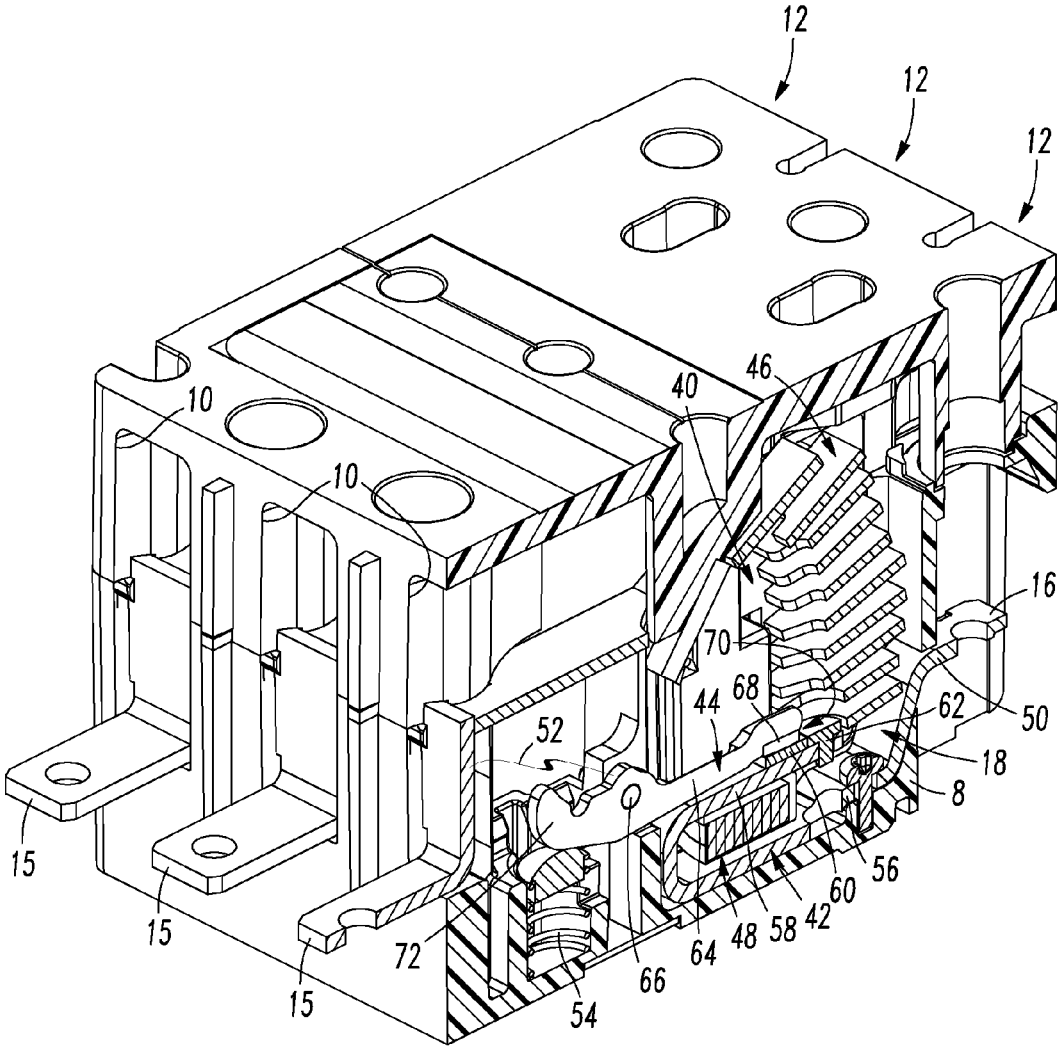
FIG. 3 is an isometric view of the limiter of FIG. 1 with some parts cut away to show internal structures.

Referring to FIGS. 1-4, an electrical switching apparatus 2 including a circuit interrupter, such as an example circuit breaker 4, and a limiter 6 is shown. The example circuit breaker 4 is a conventional three-pole circuit breaker. The limiter 6 includes a housing 8 having a number of external gas ports 10, a number of external gas vents 12 (best shown in FIG. 5) and a number of gas channels 14 (best shown in FIG. 5). Each of the number of gas channels 14 is between a corresponding one of the number of gas ports 10 and a corresponding one of the number of gas vents 12. The limiter 6 further includes a number of first terminals 15, a number of second terminals 16 (one second terminal is shown in FIG. 3), and a number of limiter devices 18 (one limiter device 18 is shown in FIG. 3). Each of the number of limiter devices 18 is electrically connected between a corresponding one of the number of first terminals 15 and a corresponding one of the number of second terminals 16. Each of the number of gas ports 10 is structured to receive a corresponding external ionized gas flow 20 for passage through a corresponding one of the number of gas channels 14 to the corresponding one of the number of gas vents 12.

During fault interruption, the ionized gas flow 20 from the circuit breaker 4 is directed through the top (with respect to FIG. 1) (e.g., without limitation, top one-third) of the limiter 6, in order to cool gases and eliminate ground conduction. A different ionized gas flow 22 (FIG. 5) from the limiter 6 does not combine with the circuit breaker ionized gas flow 20 until point 78 (FIG. 5), which is internal to the limiter 6 and prior to the corresponding limiter gas vent 12 (FIG. 5). The circuit breaker ionized gas flow 20 flows into the limiter 6 and is isolated from the limiter arc interruption structure 46 (FIGS. 3 and 4), in order to enhance overall arc interruption performance. The two ionized gas flows 20,22 combine (FIG. 5) at the gas vent 12 that allows these gasses to exit the limiter 6. This limiter gas flow structure enables a relatively close coupling between the circuit breaker 4 and the limiter 6, which saves space and provides enhanced protection from ground failures during fault interruption conditions.

The conventional circuit breaker 4 includes a housing 24 having a number of gas vents 26 (one gas vent 26 is shown in hidden line drawing in FIG. 1) structured to provide the number of ionized gas flows 20, a number of first terminals 28, a number of second terminals 30 (one second terminal 30 is shown in FIG. 1), and a number of separable contacts 32. Each of the number of separable contacts 32 is electrically connected between the corresponding one of the number of first terminals 28 and the corresponding one of the number of second terminals 30. The circuit breaker 4 also includes an operating mechanism 34 structured to open and close the number of separable contacts 32.

As shown in FIG. 1, the limiter 6 is coupled to the circuit breaker 4. Each of the limiter terminals 15 is electrically connected (FIG. 1 shows the electrical connection of one set of terminals 15,30) to a corresponding one of the circuit breaker terminals 30, in order to form a power circuit through the electrical switching apparatus 2. This power circuit is independently interruptible by either or both of the circuit breaker 4 and the limiter 6. Each of the number of gas ports 10 receives the ionized gas flow 20 from the corresponding one of the number of circuit breaker gas vents 26 for passage through the corresponding one of the number of limiter gas channels 14 to the corresponding one of the number of limiter gas vents 12.

The circuit breaker housing 24 includes a first side 36, the limiter housing includes a second side 38, and the first side 36 is mounted directly at or about the second side 38.

Typically, the circuit breaker terminals 30 are a number of line terminals, and the limiter terminals 15 are a number of load terminals, although the limiter 6 can be coupled to either the line side or the load side of the circuit breaker 4.

Referring to FIG. 3, the mechanism of the limiter 6 is now described. Each pole of the limiter 6 further includes an arc chamber 40, a stationary conductor assembly 42, a moving conductor assembly 44, an arc chute 46 (e.g., arc splitter), a slot motor assembly 48 to enhance magnetic forces during interruption, a corresponding one of the line terminals 16, a corresponding one of the load terminals 15 and a conductor 50. The load terminal 15 is electrically connected to the moving conductor assembly 44 by a flexible conductor 52.

The example limiter 6 does not have a conventional circuit breaker operating mechanism, or an overcurrent sensing device, such as a bimetal or magnetic armature. The only mechanical action that exists is when the moving conductor assembly 44 moves away from the stationary conductor assembly 42 in response to a resultant magnetic force during a fault interruption. The moving conductor assembly 44 does not latch open, but re-closes after a suitable time, responsive to spring 54, in order to restore service to the limiter 6 and the associated circuit breaker 4 (FIG. 1). The stationary conductor assembly 42 includes the conductor 50, which has a lower (with respect to FIG. 3) portion 56 coupled to the housing 8 and an upper (with respect to FIG. 3) portion 58 carrying a stationary contact 60 and an arc runner 62. The moving conductor assembly 44 includes a movable contact arm 64, which is pivotally coupled to the housing 8 at pivot 66, a movable contact 68 and the flexible conductor 52. The relatively weak spring 54 biases the movable contact arm 64 and, thus, biases the separable contacts 70, which are formed by the stationary contact 60 and the movable contact 68, closed, such that the spring force can be overcome by the relatively stronger magnetic force provided by the U-shape of the conductor 50 in combination with the slot motor 48 under a predetermined overcurrent condition. The magnetic field resulting during a fault interruption exceeds the force at the separable contacts 70 and the movable contact arm 64 moves to part the separable contacts 70. When the fault is extinguished, and after the magnetic field is removed, the same bias spring 54 provides force for the movable contact arm 64 to re-close and restore continuity through the limiter 6.

The number of limiter devices 18 (one limiter device 18 is shown in FIG. 3 for one of the poles) includes a number of the arc interruption structures 46, such as a number of the arc chutes 46, structured to provide the number of ionized gas flows 22 (FIG. 5) to the number of gas vents 12 (FIG. 5). The number of separable contacts 70 are disposed proximate the number of arc chutes 46. Each of the number of separable contacts 70 is electrically connected between the corresponding one of the number of first terminals 15 and the corresponding one of the number of second terminals 16. The slot motor 48 and the moving conductor assembly 44 provide a mechanism structured to open and close the number of separable contacts 70 of the number of limiter devices 18.

Each of the number of limiter devices 18 includes the arc chamber 40, the stationary conductor assembly 42, the moving conductor assembly 44, and the slot motor 48 structured to cause the moving conductor assembly 44 to separate from the stationary conductor assembly 42 in response to a predetermined overcurrent condition.

Each of the number of limiter devices 18 further includes the spring 54 structured to cause the moving conductor assembly 44 to move toward and normally engage the stationary conductor assembly 42. The spring 54 biases end 72 of the movable contact arm 64 upward (with respect to FIG. 3), which biases the movable contact 68 downward (with respect to FIG. 3).

Although an example three-pole limiter 6 is shown in which the number of gas ports is a plurality of gas ports 10, the number of gas vents is a plurality of gas vents 12, the number of gas channels is a plurality of gas channels 14, the number of first terminals is a plurality of first terminals 15, the number of second terminals is a plurality of second terminals 16, and the number of limiter devices is a plurality of limiter devices 18, it will be appreciated that the example limiter 6 can be a single-pole apparatus in which each of these numbers is one, or a plural-pole apparatus in which each of these numbers is any suitable plural count.

Figure 4:
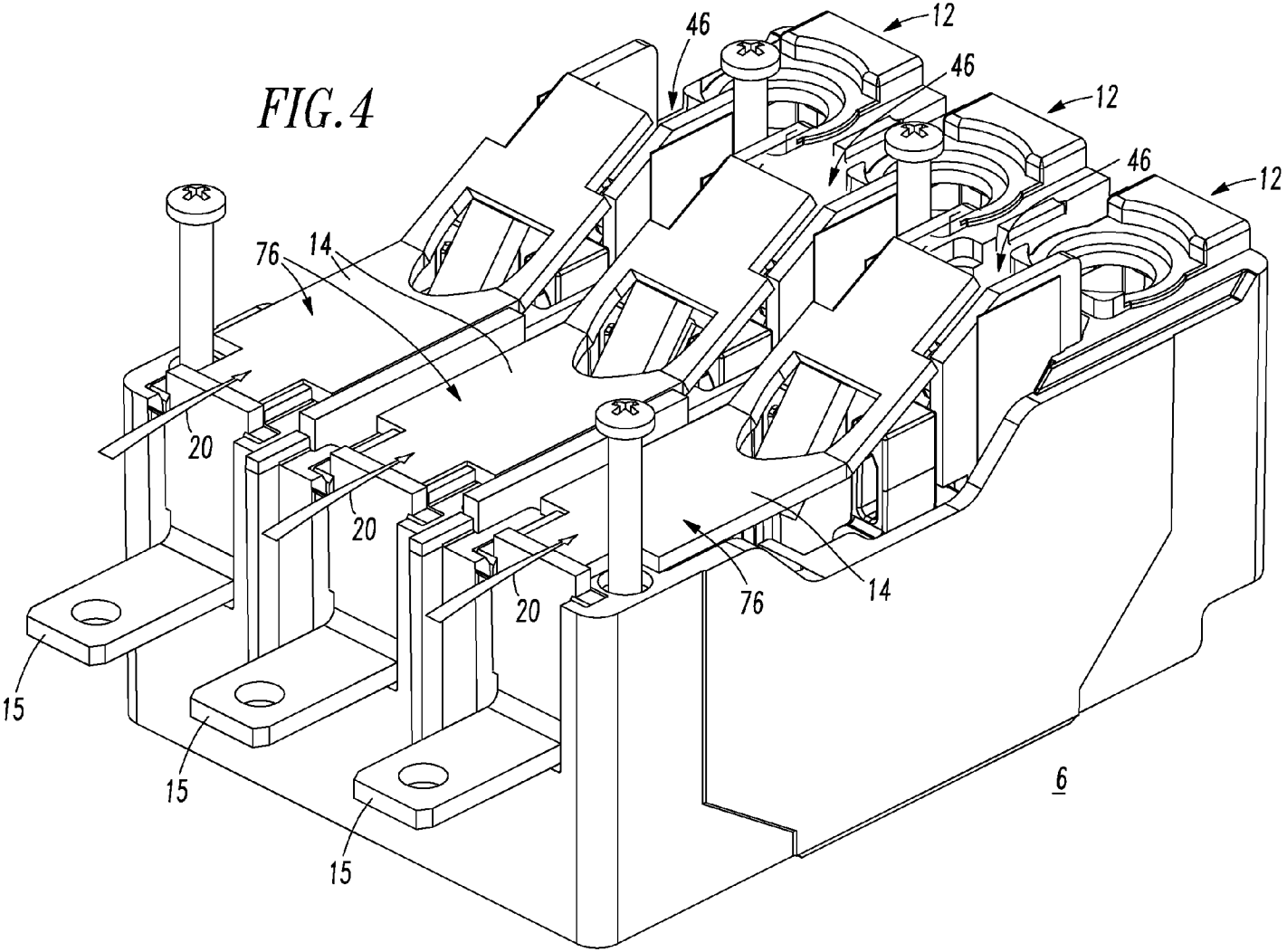
FIG. 4 is an isometric view of the limiter of FIG. 1 with the cover removed to show internal structures.
Figure 5:
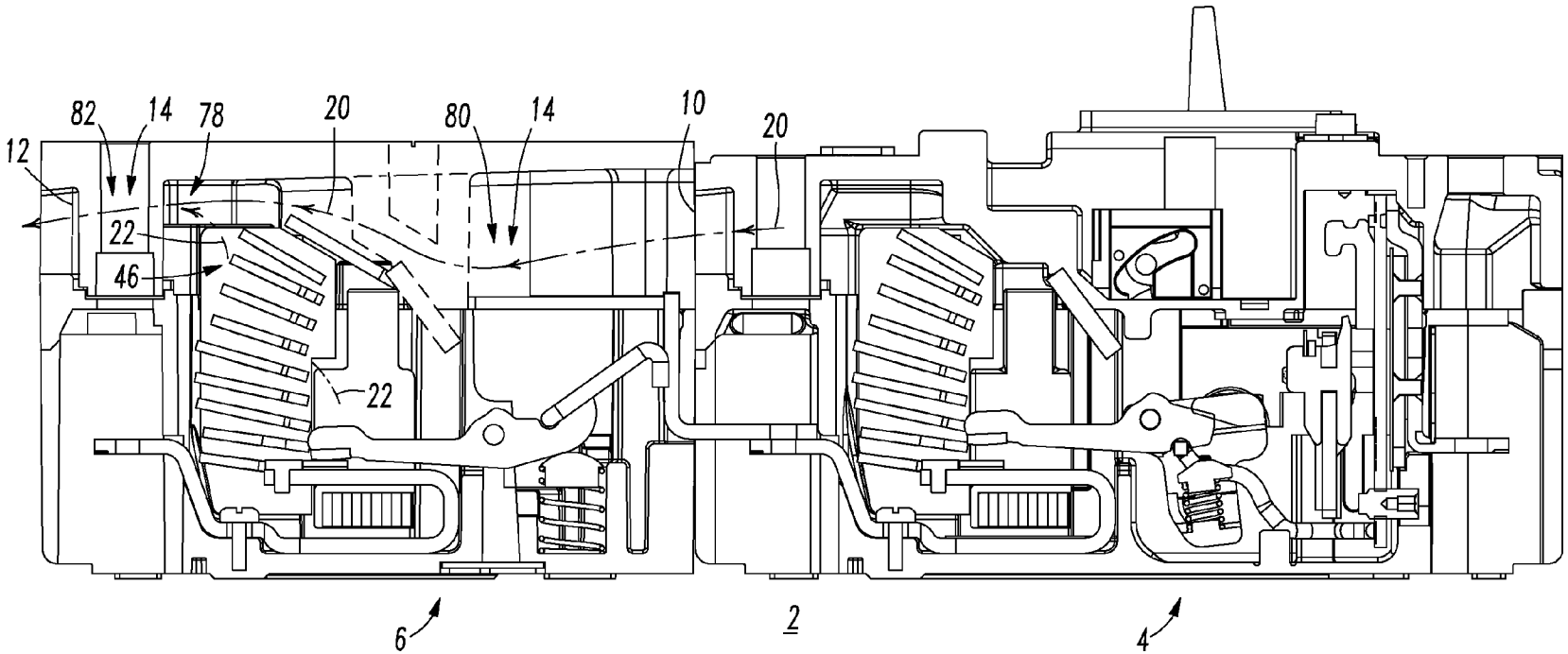
FIG. 5 is a vertical cross-sectional view of the circuit breaker and limiter system of FIG. 1.

Referring to FIG. 4, the limiter 6 of FIG. 1 is shown with the cover 74 (FIG. 1) removed to show internal structures. Part of the first gas channel 14 is a barrier 76 that separates the corresponding one of the number of ionized gas flows 20 from the corresponding one of the number of arc chutes 46. The example barrier 76 is, for example and without limitation, made of a suitable vulcanized fiber material, such as fishpaper.

Referring to FIGS. 1, 4 and 5, the disclosed concept advantageously handles the ionized gas flows 22,20 from the arc interruption structure (arc chute 46) of the limiter 6 and from the circuit breaker 4, respectively. The disclosed concept guides the circuit breaker ionized gas flow 20 through the upper (with respect to FIG. 4) internal region of the limiter 6 to avoid directing the hot ionized gasses directly to a grounded steel enclosure (not shown) housing the electrical switching apparatus 2 (FIG. 1). The disclosed concept avoids ground problems by directing ionized gas parallel to or away from the grounded steel enclosure (not shown) or mounting plates (not shown). The circuit breaker ionized gas flow 20 is vented straight into the limiter 6 mounted on the line end of the example circuit breaker 4. The ionized gas follows a "safe" path through an internal channel in the limiter 6 to avoid directing the gas toward the grounded steel enclosure (not shown) and to avoid restricting the flow of the ionized gas out of the circuit breaker 4.

The disclosed concept also avoids a ground fuse opening. During fault interruption testing per any suitable test standard, there is a fuse (not shown) or wire (not shown) that is mounted between the grounded steel enclosure (not shown) or steel plate (not shown) that the device-under-test is mounted on/in and the ground connection. If relatively too much current passes from the steel to ground, then the fuse or wire opens. When this happens, the root cause for this nonconformance is generally linked to the ionized gas from the device-under-test contacting the steel.

The example barrier 76 separates this upper (with respect to FIG. 4) circuit breaker ionized gas flow 20 from the limiter arc chamber 40 (FIG. 3), in order to enable the limiter 6 to function properly. At the end of the limiter 6, there exists a point 78 where the two ionized gas flows 22,20 (from the limiter 6 and the circuit breaker 4, respectively) combine and leave the limiter 6 into outside air, and safely away from grounded metal. This provides enhanced protection from ground failures during fault interruption conditions.

The limiter 6 can be applied to either the line side or the load side of the circuit breaker 4. The disclosed concept enables line side mounting of the limiter 6 to the circuit breaker 4. Both options are desired by customers depending upon the configuration of the device where the circuit breaker/limiter combination is used (e.g., handle mechanism location; adjacent component spacing; gas flow from one or both ends).

The isolation of the circuit breaker ionized gas flow 20 from the limiter arc chamber 40 permits the limiter 6 to not be overwhelmed by a flood of ionized gas during an interruption event that could compromise interruption efficiency.

The limiter 6 can be close-coupled to the line side of the circuit breaker 4 when sold that way from the factory. These two items could, for example, be sealed by a label (not shown) in this case to indicate that the combined units are a single unit (application rules).

Referring to FIG. 5, each of the number of gas channels 14 includes a first gas channel portion 80 communicating with a second gas channel portion 82. The first gas channel portion 80 communicates with the corresponding one of the number of limiter gas ports 10, and the second gas channel portion 82 communicates with the corresponding one of the number of limiter gas vents 12. The first gas channel portion 80 is structured to isolate the corresponding one of the number of first ionized gas flows 20 from the number of arc chutes 46. Each of the number of arc chutes 46 is further structured to provide the corresponding one of the number of second ionized gas flows 22 to the second gas channel portion 82 of the corresponding one of the number of gas channels 14. The second gas channel portion 82 is structured to combine, at point 78, the corresponding one of the number of first ionized gas flows 20 from the first gas channel portion 80 of the corresponding one of the number of gas channels 14 with the corresponding one of the number of ionized gas flows 22 prior to the corresponding one of the limiter gas vents 12. In this manner, the number of second ionized gas flows 22 from the limiter 6 does not combine with the number of first ionized gas flows 20 from the circuit breaker 4 until internal point 78, which is prior to the corresponding limiter gas vent 12.

The number of limiter gas vents 12 is structured to avoid directing an ionized gas flow directly to a grounded steel enclosure (not shown), and to avoid a ground fuse opening (not shown).

While specific embodiments of the disclosed concept have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the disclosed concept which is to be given the full breadth of the claims appended and any and all equivalents thereof.

What is claimed is:

1. An electrical switching apparatus comprising:

a circuit interrupter comprising:

a first housing including a number of first gas vents structured to provide a number of ionized gas flows, a number of first terminals, a number of second terminals, a number of separable contacts, each of said number of separable contacts being electrically connected between a corresponding one of said number of first terminals and a corresponding one of said number of second terminals, and an operating mechanism structured to open and close said number of separable contacts; and a limiter comprising:

a second housing including a number of gas ports, a number of second gas vents and a number of gas channels, each of the number of gas channels being between a corresponding one of the number of gas ports and a corresponding one of the number of second gas vents, a number of third terminals, a number of fourth terminals, and a number of limiter devices, each of said number of limiter devices being electrically connected between a corresponding one of said number of third terminals and a corresponding one of said number of fourth terminals, wherein said limiter is coupled to said circuit interrupter, wherein each of the number of third terminals is electrically connected to the corresponding one of the number of second terminals, and wherein each of the number of gas ports is structured to receive a corresponding one of the number of ionized gas flows from a corresponding one of the number of first gas vents for passage through a corresponding one of the number of gas channels to the corresponding one of the number of second gas vents.

2. The electrical switching apparatus of claim 1 wherein the number of ionized gas flows is a number of first ionized gas flows; wherein the number of separable contacts is a number of first separable contacts; and wherein the number of limiter devices comprises:

a number of arc interruption structures structured to provide a number of second ionized gas flows to the number of second gas vents, a number of second separable contacts disposed proximate the number of arc interruption structures, each of said number of second separable contacts being electrically connected between the corresponding one of said number of third terminals and the corresponding one of said number of fourth terminals, and a mechanism structured to open and close the number of second separable contacts of said number of limiter devices.

3. The electrical switching apparatus of claim 2 wherein each of the number of gas channels includes a first gas channel portion communicating with a second gas channel portion; wherein the first gas channel portion communicates with the corresponding one of the number of gas ports; wherein the second gas channel portion communicates with the corresponding one of the number of second gas vents; wherein the first gas channel portion is structured to isolate the corresponding one of the number of first ionized gas flows from the number of arc interruption structures; wherein each of the number of arc interruption structures is further structured to provide the corresponding one of the number of second ionized gas flows to the second gas channel portion of a corresponding one of the number of second gas channels; and wherein the second gas channel portion is structured to combine the corresponding one of the number of first ionized gas flows with the corresponding one of the number of second ionized gas flows prior to the corresponding one of the number of second gas vents.

4. The electrical switching apparatus of claim 3 wherein part of the first gas channel portion is a barrier that separates the corresponding one of the number of first ionized gas flows from the corresponding one of the number of arc interruption structures.

5. The electrical switching apparatus of claim 4 wherein the barrier is made of a vulcanized fiber material.

6. The electrical switching apparatus of claim 5 wherein the vulcanized fiber material is fishpaper.

7. The electrical switching apparatus of claim 1 wherein the first housing includes a first side; wherein the second housing includes a second side; and wherein the first side is mounted at or about the second side.

8. The electrical switching apparatus of claim 1 wherein each of the number of limiter devices comprises:

an arc chamber;

a stationary conductor;

a movable conductor; and a slot motor structured to cause said movable conductor to separate from said stationary conductor in response to an overcurrent condition.

9. The electrical switching apparatus of claim 8 wherein each of the number of limiter devices further comprises a spring structured to cause said movable conductor to move toward and engage said stationary conductor.

10. The electrical switching apparatus of claim 8 wherein the number of ionized gas flows is a number of first ionized gas flows; wherein each of the number of gas channels includes a first gas channel portion communicating with a second gas channel portion; wherein the first gas channel portion communicates with the corresponding one of the gas ports; wherein the second gas channel portion communicates with the corresponding one of the number of second gas vents; wherein the first gas channel portion is disposed separate from the arc chamber of a corresponding one of the number of limiter devices; wherein the arc chamber is structured to provide a second ionized gas flow to the second gas channel portion of the corresponding one of the number of gas channels; and wherein the second gas channel portion is structured to combine the corresponding one of the number of first ionized gas flows with the second ionized gas flow prior to the corresponding one of the number of second gas vents.

11. The electrical switching apparatus of claim 1 wherein the number of second terminals are a number of line terminals; and wherein the number of third terminals are a number of load terminals.

12. The electrical switching apparatus of claim 1 wherein said circuit interrupter includes a line side corresponding to one of said number of first terminals and said number of second terminals, and a load side corresponding to the other one of said number of first terminals and said number of second terminals; and wherein said limiter is structured to be coupled to the line side or the load side of said circuit interrupter.

13. The electrical switching apparatus of claim 1 wherein the second gas vent is structured to avoid directing an ionized gas flow directly to a grounded steel enclosure, and to avoid a ground fuse opening.

14. A limiter comprising:

a housing comprising a number of external gas ports, a number of gas vents and a number of gas channels, each of the number of gas channels being between a corresponding one of the number of external gas ports and a corresponding one of the number of gas vents;

a number of first terminals;

a number of second terminals; and a number of limiter devices, each of said number of limiter devices being electrically connected between a corresponding one of said number of first terminals and a corresponding one of said number of second terminals;

wherein each of the number of external gas ports is structured to receive a corresponding ionized gas flow for passage through a corresponding one of the number of gas channels to the corresponding one of the number of gas vents.

15. The limiter of claim 14 wherein said number of limiter devices comprises:

a number of arc interruption structures structured to provide a number of ionized gas flows to the number of gas vents, a number of separable contacts disposed proximate the number of arc interruption structures, each of the number of separable contacts being electrically connected between the corresponding one of said number of first terminals and the corresponding one of said number of second terminals, and a mechanism structured to open and close the number of separable contacts of said number of limiter devices.

16. A limiter comprising:

a housing comprising a number of gas ports, a number of gas vents and a number of gas channels, each of the number of gas channels being between a corresponding one of the number of gas ports and a corresponding one of the number of gas vents;

a number of first terminals;

a number of second terminals; and a number of limiter devices, each of said number of limiter devices being electrically connected between a corresponding one of said number of first terminals and a corresponding one of said number of second terminals;

wherein each of the number of gas ports is structured to receive a corresponding ionized gas flow for passage through a corresponding one of the number of gas channels to the corresponding one of the number of gas vents;

wherein said number of limiter devices comprises:

a number of arc interruption structures structured to provide a number of ionized gas flows to the number of gas vents, a number of separable contacts disposed proximate the number of arc interruption structures, each of the number of separable contacts being electrically connected between the corresponding one of said number of first terminals and the corresponding one of said number of second terminals, and a mechanism structured to open and close the number of separable contacts of said number of limiter devices;

wherein each of the number of gas channels includes a first gas channel portion communicating with a second gas channel portion; wherein the first gas channel portion communicates with the corresponding one of the number of gas ports; wherein the second gas channel portion communicates with the corresponding one of the number of gas vents; wherein the first gas channel portion is structured to isolate the corresponding ionized gas flow from a corresponding one of the number of arc interruption structures; wherein each of the number of arc interruption structures is further structured to provide the corresponding one of the number of ionized gas flows to the second gas channel portion of the corresponding one of the number of gas channels; and wherein the second gas channel portion is structured to combine the corresponding ionized gas flow from the first gas channel portion of the corresponding one of the number of gas channels with the corresponding one of the number of ionized gas flows prior to the corresponding one of the number of gas vents.

17. The limiter of claim 16 wherein part of the first gas channel portion is a barrier that separates the corresponding ionized gas flow from the corresponding one of the number of arc interruption structures.

18. The limiter of claim 17 wherein the barrier is made of a vulcanized fiber material.

19. The limiter of claim 18 wherein the vulcanized fiber material is fishpaper.

20. The limiter of claim 14 wherein each of said number of limiter devices comprises:

an arc chamber;

a stationary conductor;

a movable conductor; and a slot motor structured to cause said movable conductor to separate from said stationary conductor in response to an overcurrent condition.

21. The limiter of claim 20 wherein each of said number of limiter devices further comprises a spring structured to cause the movable conductor to move toward and engage the stationary conductor.

22. The limiter of claim 14 wherein the number of external gas ports is one external gas port; wherein the number of gas vents is one gas vent;

wherein the number of gas channels is one gas channel; wherein the number of first terminals is one first terminal; wherein the number of second terminals is one second terminal; and wherein said number of limiter devices is one limiter device.

23. The limiter of claim 14 wherein the number of external gas ports is a plurality of external gas ports; wherein the number of gas vents is a plurality of gas vents; wherein the number of gas channels is a plurality of gas channels; wherein the number of first terminals is a plurality of first terminals; wherein the number of second terminals is a plurality of second terminals; and wherein said number of limiter devices is a plurality of limiter devices.

* * * * *